United States Patent [19]

Blackwell et al.

[11] Patent Number: 4,811,648

[45] Date of Patent: Mar. 14, 1989

[54] MUZZLE BRAKE DEVICE

[76] Inventors: David L. Blackwell, Rte. 1, Lot 14; Paul E. Stratton, Jr., 155 Unger St., both of Gnadenhutten, Ohio 44629

[21] Appl. No.: 96,061

[22] Filed: Sep. 14, 1987

[51] Int. Cl.[4] ..... F41F 17/12

[52] U.S. Cl. ..... 89/14.3

[58] Field of Search ..... 42/79; 89/14.3, 14.4

[56] References Cited

U.S. PATENT DOCUMENTS

| | | | |
|---|---|---|---|
| 2,212,684 | 8/1940 | Hughes | 89/14.3 |
| 2,212,685 | 8/1940 | Hughes | 89/14.3 |
| 2,916,970 | 12/1959 | Mutter | 89/14.3 |
| 3,152,510 | 10/1964 | Ashbrook et al. | 89/14.3 |
| 3,155,003 | 11/1964 | Ruth | 89/14.3 |
| 4,643,073 | 2/1987 | Johnson | 89/14.3 |
| 4,691,614 | 9/1987 | Leffel et al. | 89/14.3 |

*Primary Examiner*—Deborah L. Kyle
*Assistant Examiner*—Richard Klein
*Attorney, Agent, or Firm*—Oldham & Oldham Co.

[57] ABSTRACT

A muzzle brake device for a handgun comprises a housing disposed at the end of the barrel thereof, which includes a conical expansion chamber tapered outwardly from the barrel bore of the gun and connecting with a cylindrical passageway at the chamber's muzzle end. A strike plate having a truncated planar surface in the shape of the truncated planar surface of a hollow, annular, truncated cylinder, facing the breech end of the gun, is positioned in the passageway. A number of pressure port passageways communicating between the interior of the device, and the outside thereof, are provided to reduce muzzle rise and for other beneficial purposes.

12 Claims, 4 Drawing Sheets

MUZZLE BRAKE DEVICE

TECHNICAL FIELD

This invention relates to a device for improving the operation, accuracy, and muzzle velocity of fire arms. More particularly, this invention relates to a device designed to reduce the recoil experienced during the discharge of a fire arm resulting from the reactive forces created thereby. Specifically, this invention relates to a muzzle brake device attached to the end of the barrel of a fire arm which causes the redirection of propellant gases formed when the fire arm is discharged, thereby attenuating the recoil energy and reducing the upward movement or "rise" of the barrel, while at the same time substantially reducing the noise produced.

BACKGROUND OF THE INVENTION

The recoil of a fire arm resulting from its discharge is a well known phenomenon, and one which is in inherent to a greater or lesser extent in the operation of all fire arms. The recoil problem not only results in discomfort to the shooter, but seriously adversely affects the results obtained. The basic design of fire arms such as pistols, rifles, shot guns, and other similar weapons especially those commonly referred to as "handguns", as well as the manner in which they must be physically held during firing, tends to cause the muzzle to move upward, or "rise", when the weapon is fired. At the same time, a sudden backward movement of the gun is produced, known as "kick". Both these effects are particularly noticeable in connection with the firing of automatic or semi-automatic weapons, causing inaccuracy. In addition, the shooter's anticipation of the recoil tends to cause "flinching" as the weapon is fired, i.e., jerking of the weapon as the trigger is pulled, also resulting in inaccuracy.

The forces of recoil and their adverse effects have long been recognized; consequently, they have been the subject of much study, and a great deal of effort has been spent on attempting to eliminate, or at least to minimize them. The recoil force basically is comprised of three elements: the first of these is the action/reaction of the bullet accelerating within the barrel of the fire arm. The second, similar recoil effect is due to the acceleration of the propellant gases in the process of driving the bullet down the barrel. The reactive effect of the aforementioned elements is inherent in the discharge of a fire arm; consequently, little if anything can be done to eliminate it without adversely affecting the forces of acceleration which produce the desired muzzle velocity of the weapon's projectile.

The third element of the recoil force, and the one which as a practical matter produces about half of the recoil energy, is that produced by the rocket-like effect imparted to the fire arm when the bullet leaves its barrel and the trapped gases are released. These gases rush out of the barrel, pushing the fire arm backwards due to reaction, the same way that a modern rocket is propelled upwards at the moment of launch by the exiting propellant gases. It is this element of the recoil, which can be altered without detrimentally affecting the firing process, which the device of the invention disclosed herein seeks to minimize with the beneficial results obtained thereby.

As mentioned, the recoil phenomonen, and the problems associated therewith, have been recognized almost since the first fire arm was discharged, and, there have been numerous attempts to avoid the difficulty. One method which has been employed involves the addition of extra weight to various parts of the gun, thereby increasing its mass, and correspondingly reducing the recoil velocity. While this solution beneficially minimizes the problems associated with recoil, it results in additional problems. For example, when additional weight is incorporated in a fire arm, it gives rise to target acquisition problems such as "swing by", produced by the additional momentum resulting from the added weight, which causes the weapon to overtravel its intended aiming point. Numerous other approaches, including the provision of gas escape ports at right angles to the weapon's barrel, have also been resorted to in an effort to reduce the amount of propulsion gases discharged in the direction longitudinal to the weapon's barrel, so as to decrease the reactive focces associated therewith Such attempts, and the devices related thereto, have in many instances enjoyed some success. However, they have had problems attendant to them, including such things as generally high noise levels, and the discharge of propellant debris towards the shooter, thus interfering with aiming of the weapon. In some instances, these devices have also resulted in difficulties with the automatic ejection of spent cartridge casings, and the cleaning and maintenance of such devices generally has been a problem.

DISCLOSURE OF THE INVENTION

In light of the foregoing, it is a first aspect of the invention described herein to provide a device which reduces the tendency of fire arms to exhibit muzzle rise upon discharge.

It is a second aspect of the invention to allow fire arms to be discharged with greater accuracy, particularly when fired in an automatic, or semi-automatic mode.

It is another aspect of this invention to provide a device which reduces the noise produced by fire arms upon discharge.

It is a further aspect of this invention to provide a recoil reducing device which may be readily disassembled for easy cleaning.

A still further aspect of the herein disclosed invention is the provision of a recoil-reducing muzzle brake device which may be easily attached to the end of a fire arm's barrel.

One aspect of this invention is to provide a device which greatly reduces the failure of fire arms on which it is installed to eject spent casings properly.

An additional aspect of the invention is to reduce interference from ejected debris produced during the firing process with aiming of the fire arm.

Yet another aspect of the muzzle brake device of the invention is the provision of a device which can be installed and used on a fire arm with standard assembly methods, parts, and functioning.

A further aspect of this invention is to make available a muzzle brake device which is simple, inexpensive, and durable.

Another aspect of the invention in many instances is to increase the muzzle velocity of projectiles leaving the fire arm.

A further aspect of the muzzle brake device of the invention is frequently to allow the installation and use of the device without creating any necessity for modifying or replacing the aiming sight with which the fire arm is provided.

Other aspects of the invention herein described are furnished by a handgun provided with a muzzle brake device comprising in combination:

a housing;

means for securing said housing to the end of the gun's barrel; and a strike plate, wherein said housing includes therein a truncated conical expansion chamber having an annular surface in the shape of a horizontal, hollow, truncated cone, the base or muzzle end of which defines the transverse cross sectional area of a cylindrical passageway also contained in said housing, and the truncated top or breech end of which defines the transverse cross sectional area of the barrel bore of said gun, there being disposed in the cylindrical passageway at the muzzle end of said expansion chamber a strike plate having an angled surface facing said expansion chamber in the shape of the truncated surface of a hollow, annular, truncated cylinder, said truncated surface forming an angle relative to the bottom of said cylindrical passageway of about 30° to 45° with the longitudinal axis of said hollow, annular, truncated cylinder, said angled surface lying at right angles to the longitudinal vertical plane of the cylindrical passageway, and wherein said housing has a plurality of pressure port passageways connecting the interior of said housing to the outside of said housing.

Still additional aspects of this invention are attained by a muzzle brake device for a gun comprising in combination:

a housing;

means for securing said housing to the end of the gun's barrel; and a strike plate, wherein said housing includes therein a truncated, conical expansion chamber having an annular surface in the shape of a horizontal, hollow, truncated cone, the base or muzzle end of which defines the transverse cross sectional area of a cylindrical passageway also contained in said housing, and the truncated top or breach end of which defines the transverse cross sectional area of the barrel bore of said gun, there being disposed in the cylindrical passageway at the muzzle end of said expansion chamber a strike plate having an angled surface facing said expansion chamber in the shape of the truncated surface of a hollow, annular, truncated cylinder, said truncated surface forming an angle relative to the bottom of said cylindrical passageway of about 30° to 45° with the longitudinal axis of said hollow, annular, truncated cylinder, and said angled surface lying at right angles to the longitudinal vertical plane of the cylindrical passageway, and wherein said housing has a plurality of pressure port passageways connecting the interior of said housing to the outside of said housing.

BRIEF DESCRIPTION OF THE DRAWINGS

The invention will be better understood when reference is had to the following drawings, in which like numbers represent like parts.

BEST MODE FOR CARRYING OUT THE INVENTION

Figure 1:
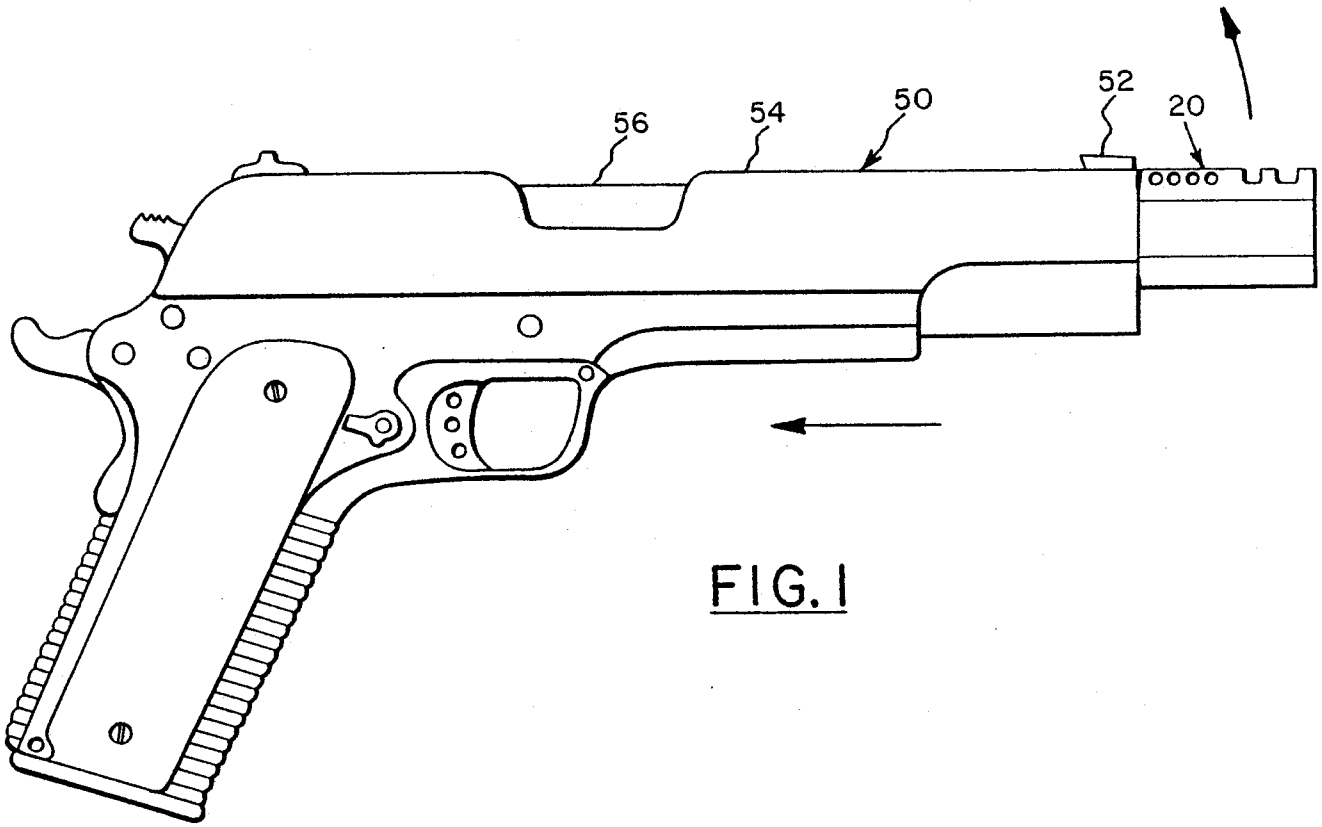
FIG. 1 is a side view of a semiautomatic handgun with the muzzle brake device of the invention attached to the end of the barrel thereof.

FIG. 1 shows a handgun 50 with a muzzle brake device 20 of the invention. The Figure shows the gun sight 52 mounted on the gun slide 54, as well as an opening 56 for the ejection of spent cartidge casings. During firing, recoil of the gun is primarily rearwards, as well as upwards, shown by the direction of the arrows in the Figure. As mentioned in the preceding, in the case of automatic or semiautomatic weapons fitted with poorly designed muzzle brake devices, the ejection mechanism of the weapon frequently exhibits a tendency to jam, rendering the weapon temporarily ineffective with the adverse consequences which that entails.

Figure 2:
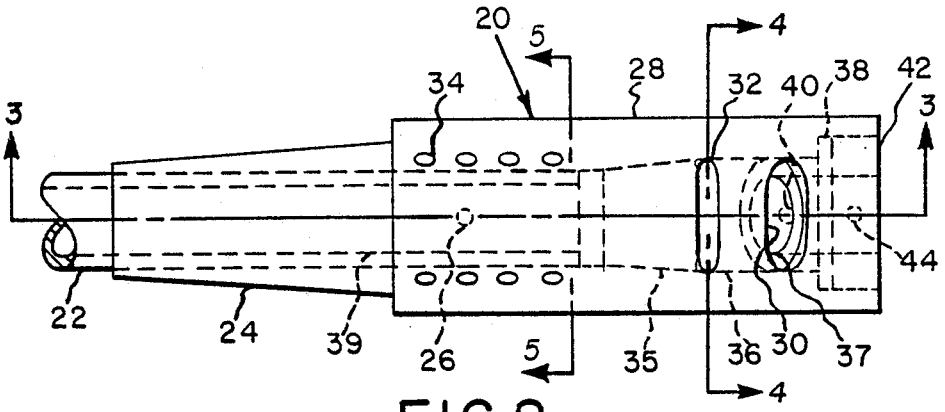
FIG. 2 is a top view of a muzzle brake device of the invention showing a broken away section of the gun's barrel.

FIG. 2 shows a top view of the muzzle brake device 20 mounted on the end of the gun barrel 22. The muzzle brake device comprises a muzzle brake housing 28 integrally connected to mounting cone sleeve 24 which connects the muzzle brake device to the end of gun barrel 22. When manufactured as a separate unit the muzzle brake device may be attached to the gun barrel by any of numerous methods as, for example, by threading, soldering, bonding, as well as by other methods. Alternatively, as explained in the discussion of FIG. 9, below, the muzzle brake device may be manufactured as an integral part of the gun barrel by appropriate machining during the manufacturing process. As shown by the Figure, housing 28 includes a barrel bore chamber 39 which connects with an expansion chamber 35. Expansion chamber 35, in turn, connects with cylindrical passageway 36 containing front low port pressure passageway 30 and rear low pressure port passageway 32 at its top. The low pressure port passageways 30 and 32 desirably comprise passageways of elongated cross section, the longer dimensions of which are disposed at right angles to the longitudinal axis of the gun barrel 22. A number of high pressure port passageways 34 are also disposed along the top of muzzle brake housing 28, and passageways to barrel bore chamber 39. The number and positioning of the high pressure port passageways 34 may vary; however, in order to avoid interference with the shooter's line of sight, to provide multidirectional dispersal of propellant gases-reducing noise levels, and to promote gun stability during recoil, it has been found advantageous to locate high pressure port passageways 34 in several longitudinal lines, relative to the axis of the gun barrel, with each of said lines being spaced away from the center of muzzle brake housing 28. Cylindrical passageway 36 also includes strike plate 37, a primary operative feature of which is a surface which faces the expansion chamber 35 and which serves the purpose of directing some of the expansion gases formed during the burning of the propellant charge upward through front low pressure port passageway 30. The operative surface of strike plate 37 is formed by the truncated surface of a hollow, annular, truncated cylinder which may either be an integral part of cylindrical passageway 36, or more preferably, be removeable therefrom.

When strike plate 37 is removable, as shown in FIG. 2, it can be withdrawn from muzzle brake housing 28, and the interior of the muzzle brake device 20, including cylindrical passageway 36, expansion chamber 35 and the adjacent areas may be cleaned. During operation of the fire arm, debris including propellant deposits, projectile metal, and associated materials gradually accumulate, reducing, and eventually destroying, the beneficial effect of the muzzle brake device. The ability to secure access to such areas by removal of strike plate 37 is, therefore, one of the significant advantages of the muzzle brake device with which the invention is concerned. In the Figure, strike plate 37, which includes shoulder rim 38, is held in place in the cylindrical passageway 36 by means of retaining ring 42 which is positioned against the base of the strike plate. While not essential to the functioning of the muzzle brake device, shoulder rim 38 provides frictional engagement with a counterpart surface in muzzle brake housing 28, and helps to hold strike plate 37 in its intended position of use. Also securing strike plate 37 in its position of use is setscrew 40 which extends through muzzle brake housing 28, for example, engaging the bottom of strike plate 37, and preventing the movement thereof. When strike plate 37 is of a type removable from cylindrical passageway 36, it is constructed in the form of the hollow, annular, truncated cylinder previously described which has an outside diameter slightly smaller, for instance, about a few thousandths of an inch smaller than the inside diameter of the cylindrical passageway so that it can slide in and out thereof. The retaining ring 42 may be conveniently be inserted in cylindrical passageway 36 by threading. However, it may also be secured therein in other ways, for example, by a bayonet mounting, or otherwise. The use of a thread sealant on setscrews 40 and 44 is frequently employed.

Figure 3:
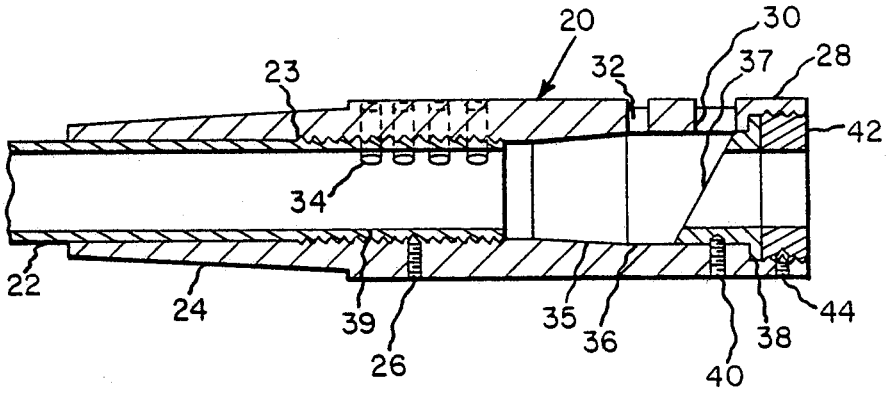
FIG. 3 is a longitudinal cross section of the muzzle brake device along line 3—3 of FIG. 2.

FIG. 3 is a cross sectional view of the muzzle brake device 20 along the line 3–3 of FIG. 2. The Figure shows muzzle brake housing 28 integrally attached to cone sleeve 24, allowing the muzzle brake device to be attached to gun barrel 22 by means of threads 23. Muzzle brake housing 28 and strike plate 37 disposed therein, are secured by shoulder rim 38 and setscrew 40. Also holding strike plate 37 in place is retaining ring 42, threadably fastened into muzzle brake housing 28 and secured by setscrew 44. As can be seen, the truncated surface of strike plate 37 faces expansion chamber 35. Disposed at the top of, and penetrating the muzzle brake housing 28 above and directly over the truncated surface of the strike plate is the front low pressure port passageway 30, while a second low pressure port passageway 32 lies above and directly over the area immediately adjacent to the breech end of strike plate 37. Also penetrating muzzle brake housing 28 are the high pressure port passageways 34 which extend into barrel bore chamber 39.

While the invention is not to be considered as being confined thereto, it is theorized that in the process of discharging the fire arm, the propellant gases rush down barrel bore chamber 39 until they reach expansion chamber 35, an angular surface in the shape of a horizontal, hollow, truncated cone, the base or muzzle end of which defines the transverse cross sectional area of cylindrical passageway 36, while the truncated top or breech end of the expansion chamber defines the transverse cross sectional area of barrel bore 39. Propellant gases discharging from an opening such as the end of barrel bore chamber 39 normally have a conical angle of discharge relative to the longitudinal axis of the opening from which they are discharging of around 15°. This angle is maintained, more preferably somewhat reduced, by the conical angular shape of expansion chamber 35, thus compressing the propellant gases. The propellant gases are thereby in a more dense condition which is favorable for their subsequent impact with strike plate 37. As the propellant gases impact strike plate 37, a substantial amount of them are deflected by the angle of the strike plate 37 upwards and out of front low pressure port passageway 30. The reactive forces comprising the impact, include a vertical as well as a horizontal force component. The forward horizontal component tends to drive the gun forward offsetting the rearward thrust of the recoil reaction, while the downward vertical component forces the gun downward, offsetting the tendency of the gun to rise as a result of the force of recoil. As pressure from the propellant gases begins to subside as a result of the exhausting of the gases through front low pressure port passageway 30, a shock wave is directed back along the longitudinal axis of the barrel bore chamber 39.

Rear low pressure port passageway 32 serves the purpose of relieving and breaking up this back pressure shock wave. Rear low pressure point passageway 32 also serves to reduce the noise level of the gun's discharge considerably below that which would be present where only a single low pressure port passageway is provided. Likewise reduced by the provision of multiple low pressure port passageways, is the tendency of the gun to expel burnt powder and other debris from the low pressure port passageways, interfering with the shooter and his sighting. In addition to processing the exiting propellant gases as described, expansion chamber 35 is designed to act in a manner similar to that of a tuned expansion chamber in the exhaust pipe of a two-stroke engine. In the absence of the conical surface of expansion chamber 35, the shock wave speeding rearwards from the strike plate 37 would encounter a 90 degree perpendicular wall, the juncture of barrel bore chamber 39 and the cylindrical passageway 36. A "dead eddy" area would thus be created at the juncture, providing a point of turbulence. It is thought that the gas shock waves travel back and forth through the barrel and associated regions of the gun, striking the interior base of the cartridge casing intermittently. This back and forth movement of shock waves apparently creates alternating vacuum and pressure effects which interfere with the locking and unlocking action of the barrel in slide 50, causing cartridge casing extraction malfunctions Expansion chamber 35 helps avoid this result by directing the shock waves and the residual expanding gases back down barrel bore 39 as the pressure within the barrel bore subsides, assisting in the extraction and ejection of the spent cartridge casings in weapons of the automatic and semiautomatic type. Expansion chamber 35 and the rear low pressure port passageway 32 interact in accomplishing avoidance of the malfunction problems, and in fact, the combined installation of the two has been found to result in a decrease in ejection malfunctions of as much as about 10 to 20 percent in some government model semi-automatic handguns. In addition, the provision of expansion chamber 35 can reduce recoil and muzzle rise in some weapons by as much as about 5%.

Experience has established that in order to accomplish the results described, certain guidelines should be observed regarding the relationship between the length of expansion chamber 35, its base diameter, and the internal diameter of barrel bore chamber 39. It has been shown, for instance that the maximum internal or base diameter of expansion chamber 35, which occurs at its juncture with cylindrical passageway 36 should be from about 1.5 to 2.0 times the internal diameter of the barrel bore chamber 39 of the gun. Since there is a relationship between the length of expansion chamber 35 and the angle of the surface defined by the horizontal, hollow, truncated cone defining its shape, relative to the longitudinal axis of the cone, when such angle is in the preferred range of from about 10 to 15 degrees, it is desirable that the length of the expansion chamber measured along its horizontal axis be from about 0.62 to 0.64 inches, most preferably in the vicinity of about 0.63 inches. The design of the muzzle brake device according to the dimensions described, greatly increases its beneficial action relative to recoil, while the reverse is also true. For example, reduction of the internal length of expansion chamber 35 to 0.50 inches in certain handguns increases their recoil, relative to such handgun fitted with a muzzle brake of the invention, by up to about 10% to 16%. A more optimal ratio of the largest internal diameter of the expansion chamber 35 to the internal diameter of the barrel bore 39 of a handgun is about 1.6 in the case of a .45 caliber weapon, and about 1.9 for a .38 caliber or 9 millimeter weapon.

With respect to strike plate 37, the truncated surface of the hollow, annular, truncated cylinder which forms the strike plate, should lie at about right angles to the longitudinal vertical plane of cylindrical passageway 36. Furthermore, desirably, the truncated surface should form an angle between itself and the bottom of cylindrical passageway 36 preferably of about 30° to 45° as previously described, in cases where strike plate 37 is removable from cylindrical passageway 36, the internal diameter of the latter should be at least about 0.002 inches greater than the outside diameter of the strike plate.

With respect to the low pressure port passageways 30 and 32, in order to obtain full benefit of such passageways, it is preferred that they extend at right angles to, and across the full width of cylindrical passageway 36. In the case of .45 caliber weapons, the area of front low pressure port passageway 30 should desirably be from about 0.22 to 0.23 square inches, while for a .38 caliber or 9 millimeter weapon, an area of from about 0.30 to 0.32 square inches is preferred. For the .45 caliber weapon, the front low pressure port passageway 30 will also have an area of about 1.4 to 1.6 times the area of rear low pressure port passageway 32.

High pressure port passageways 34 provide an additional means for exhausting propellant gases from the muzzle brake device 20, thereby allowing a further reduction in recoil and muzzle rise. The high pressure port passageways 34 derive their name from the fact that the propellant gases leaving the barrel through such passageways do so while the gases are still confined under high pressure, due to the fact that the projectile remains captive in the muzzle bore chamber 39 of the weapon. It has been determined that when the transverse cross sectional area of the high pressure port passageways 3 comprises about 20 to 25% of the cross sectional area of barrel bore chamber 39, recoil reductions of up to about 15% can be obtained. However, when the transverse cross sectional area of such passageways is increased above about 30%, no further recoil improvement is normally achieved. Furthermore, while the extension of the effective length of barrel bore chamber 39 inherent in some embodiments of the muzzle brake device of the invention can provide greater muzzle velocities than would be the case in the absence of the device, when the transverse cross sectional area of high pressure port passageways 34 is increased above the 20% to 25% range, the primary effect may be an undesirable reduction in muzzle velocity and no improvement in recoil reduction. The area of the high pressure port passageways 34 may be distributed in a plurality of passageways located in various ways; however, the provision of two rows of passageways exiting the top of muzzle brake housing 28 from areas on either side of the area directly over barrel bore 39 chamber is particularly advantagous. In a preferred mode, the high pressure port passageways 34 are arranged at an angle of about 20° to 45° from the perpendicular, disposed in transverse planes at right angles to the longitudinal axis of barrel bore chamber 39. In such an arrangement, the passageways are desirably located on the top of muzzle brake housing 28 at locations such that when the angle of disposition is as specified, the passageways which penetrate to the barrel bore chamber 39 would, if continued by imaginary lines, pass through an area approximating the center of the barrel bore chamber. Locating high pressure ports 34 of the type, and in the manner described, appears to reduce the turbulence of the propellant gases in barrel bore chamber 39, and as has been previously stated, positioning of the high pressure port passageways to the sides of the top of muzzle brake housing 28 provides less interference from exiting gases and debris during aiming of the weapon by the shooter, improves stability during recoil, and improves noise reduction through multidirectional gas dispersal, thus helping assure greater accuracy.

Figure 4:
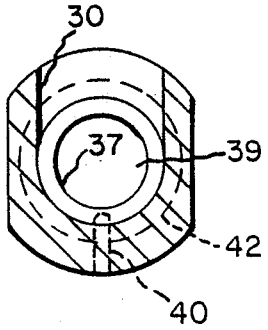
FIG. 4 is a cross section of the invention along line 4—4 of FIG. 2.

FIG. 4 is a transverse cross section of the muzzle brake device of the invention along line 4—4 of FIG. 2 clearly showing how the low pressure port passageways 30 and 32 extend the full width of cylindrical passageway 36, providing easy access for the propellant gases leaving cylindrical passageway 36. The Figure also shows retaining ring 42 holding strike plate 37 in place. Setscrew 40, which maintains the angular disposition of strike plate 37, is also shown.

Figure 5:
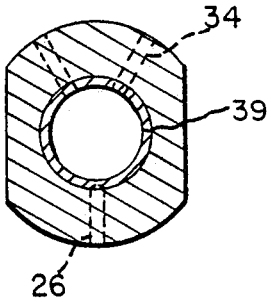
FIG. 5 is a cross section of the brake device of FIG. 2 along line 5—5.

FIG. 5 is a transverse cross section of the muzzle brake device of the invention 20 along line 5—5 of FIG. 2 looking toward the rear or breech end of the weapon. The Figure shows how the high pressure port passageways 34 are disposed at about a 20° to 45° angle from the vertical in planes perpendicular to the longitudinal axis of barrel bore chamber 39. As can be seen in the Figure, when imaginary lines are passed through high pressure port passageways 34, they meet in the area of the center of barrel bore chamber 39.

Figure 6:
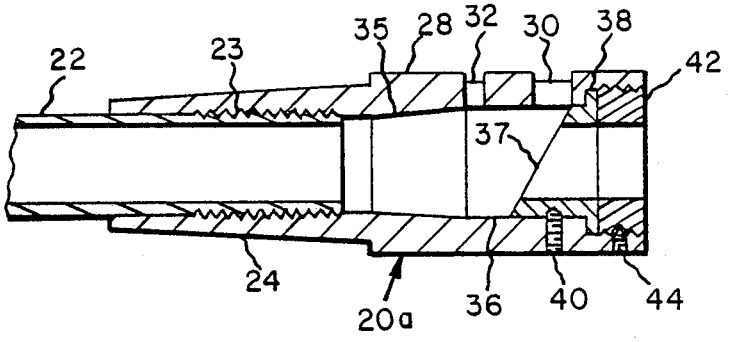
FIG. 6 is a longitudinal center cross section of a modified brake device of the invention in which no high pressure port passageways have been disposed

FIG. 6 shows a partial cross section through the longitudinal center of a muzzle brake device of the invention which does not include high pressure port passageways. Although the high pressure port passageways 34, shown in connection with preceding Figures, provide the advantages described in the discussion thereof, it is sometimes desirable to provide a shorter, lighter weight muzzle brake device. This can be accomplished by provision of the muzzle brake device shown in FIG. 6 in which high pressure port passageways 34 have been eliminated, producing a shorter, lighter weight device. In the Figure, a muzzle brake device is shown comprising muzzle brake housing 28 which is integrally connected with cone sleeve 24. The muzzle brake device is attached to gun barrel 22 by means of threads 23. With the exception of the high pressure port passageways 34, the muzzle brake device of the Figure includes elements of the embodiment previously discussed, including front and rear low pressure port passageways 30 and 32, respectively, cylindrical passageway 36, expansion chamber 35, strike plate 37, including shoulder rim 38, the strike plate being held in position by set-screw 40, and retaining ring 42 secured by setscrew 44. While the muzzle brake device of FIG. 6, termed a "short brake", does not produce as much recoil reduction as a muzzle brake device equipped with high pressure port passageways, it does allow the weapon to be handled somewhat more easily, since it is shorter and lighter than muzzle brake devices containing high pressure port passageways, a desirable feature in some situations.

The wall thickness of the muzzle brake housing 28 and cone sleeve 24 of the invention is not particularly critical, since in the case of the muzzle brake housing, pressure containment is relatively unimportant. With respect to cone sleeve 24, for most of its length, the cone sleeve is reinforced by gun barrel 22. Consequently, any wall thickness sufficient to maintain the structural integrity of the muzzle brake device and able to accommodate the threading of gun barrel 22 and that of retaining ring 42, when employed, generally is suitable for purposes of the invention. Within the limits of the functional requirements described, it is desirable to maintain minimal wall thicknesses to reduce the weight of the muzzle brake device.

Figure 7:
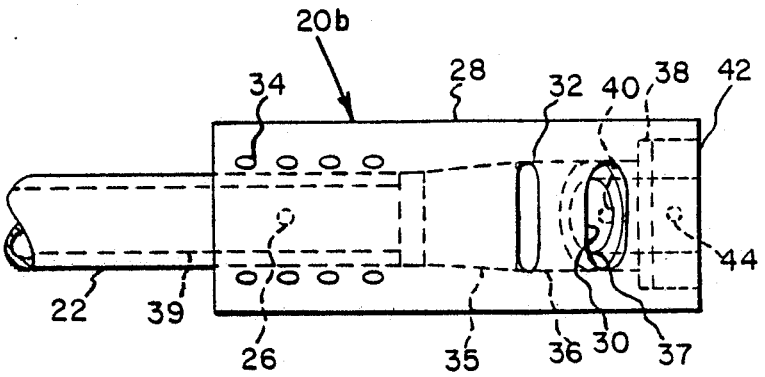
FIG. 7 is a top view of the muzzle brake device of FIG. 2 provided with a modified mounting system.

FIG. 7 shows a top view of a muzzle brake device 20(*b*) of the type taught by the invention mounted directly on gun barrel 22 without the assistance of the cone sleeve 24 which is shown in the other Figures. When the muzzle brake device is attached to the gun barrel without the cone sleeve, the arrangement is termed as a "drop in barrel", since it allows the gun barrel and muzzle brake device to be constructed as a single unit, interchangable with a standard gun barrel without modification of the gun itself. Thus the shooter can switch back and forth between the standard barrel without a muzzle brake device, and a barrel equipped with such a device. This leaves the gun unaltered, a desirable feature in the eyes of some shooters, and it also reduces cost, since no modification of the gun to accommodate the muzzle brake device is needed. Use of the cone sleeve attachment, on the other hand, involves some modification of the slide of the gun by methods well known in the art, but it has the advantage of producing an unbroken, pleasing appearance at the juncture of the muzzle brake device and the slide of the gun.

With the exception of the absence of the cone sleeve 24, the muzzle brake device of the Figure essentially, the same as that of FIG. 2 in that it, comprises muzzle brake housing 28 which includes front and rear low pressure port passageways 30 and 32, respectively, high pressure port passageways 34, expansion chamber 35 and cylindrical passageway 36, as well as retaining ring 42 and strike plate 37, the component parts being held in their proper position by set screws 26, 40, and 44.

Figure 8:
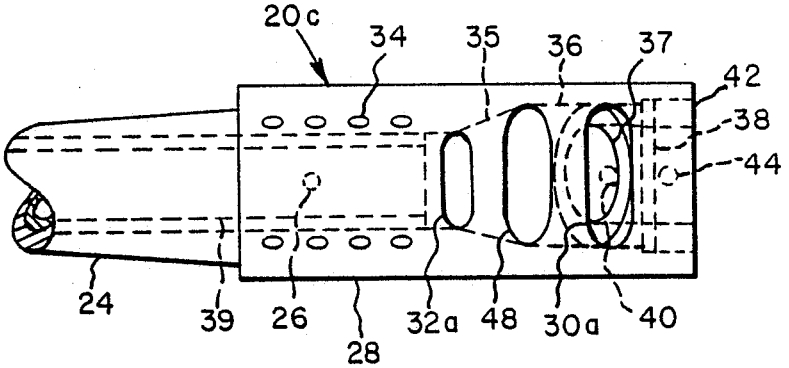
FIG. 8 shows a top view of another modified brake device of the invention.

FIG. 8 is a top view of a smaller caliber weapon such as a .38 caliber or 9 millimeter gun equipped with the muzzle brake device 20(*c*) of the invention. As will be seen from the Figure, the muzzle brake device includes a front low pressure port passageway 30(*a*), a middle low pressure port passageway 48, and a rear low pressure port passageway 32(*a*). The transverse cross sectional area of front low pressure port passageway 30(*a*) will normally be about the same as that of the middle low pressure port passageway 48; however, the area of each such low pressure port passageway will be about 3.5 to 4.5 times that of rear low pressure port passageway 32(*a*). It has been determined that the total transverse cross sectional area of such low pressure port passageways will be from about 0.30 to 0.32 square inches. While some positional latitude is permissable, location of the middle low pressure port 48 about equidistant between front low pressure port passageway 30(*a*) and rear low pressure port passageway 32(*a*) has been found to be preferable.

With the exception of the added low pressure port passageway 48, the muzzle brake device of FIG. 8 is essentially the same as that of the muzzle brake device of FIG. 2 in that it comprises a muzzle brake housing 28 which contains an expansion chamber 35, as well as a cylindrical passageway 36, high pressure port passageways 24, a strike plate 37, a retaining ring 42, and the necessary setscrews 26, 40 and 44 to hold components of the muzzle brake device 20(*c*) in their proper position.

Figure 9:
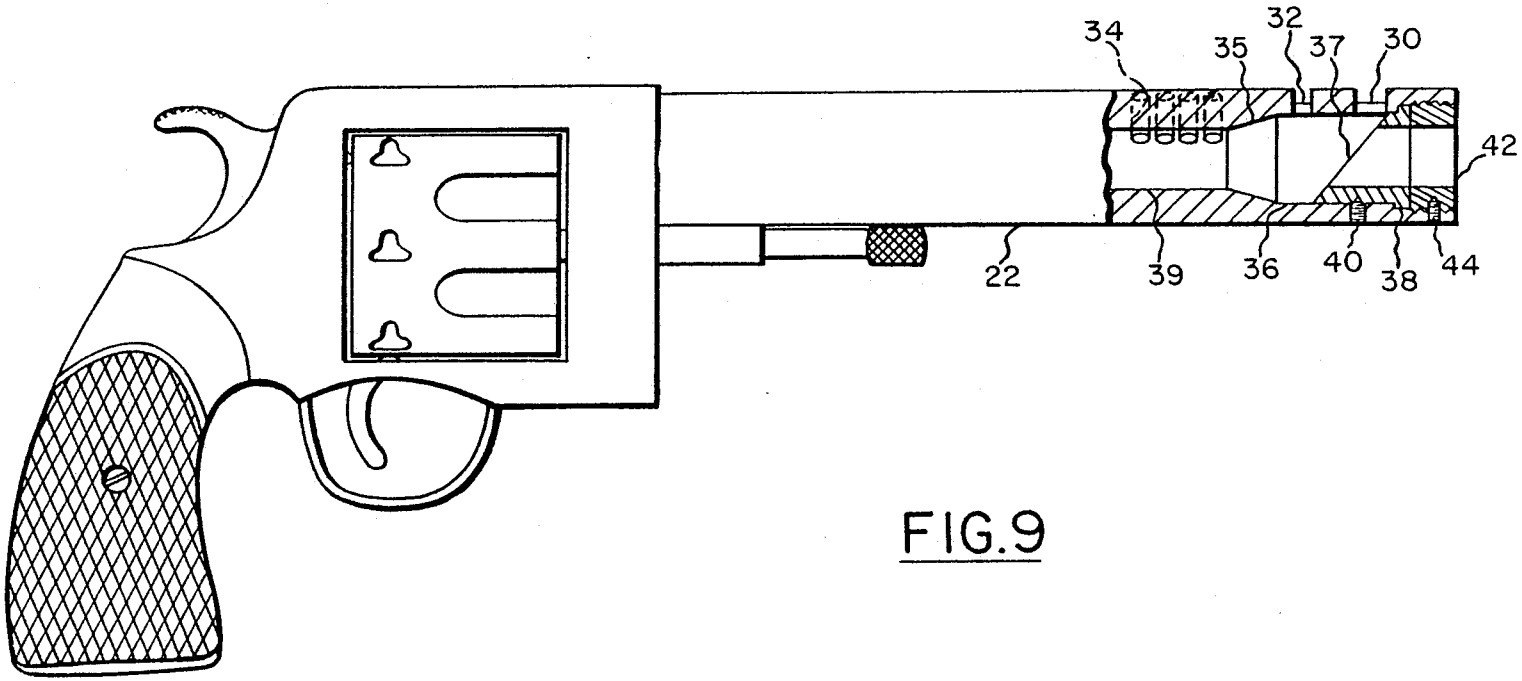
FIG. 9 is a partially sectioned side view of a revolver handgun with the muzzle brake device of the invention installed as an integral part of the gun barrel.

FIG. 9 shows a partially sectioned side view of a revolver handgun in which the muzzle brake device of the invention has been installed as an integral part of the gun barrel. The Figure shows a gun barrel 22 in which the bore chamber terminates in the expansion chamber 35. As in the case of the muzzle brake device of FIG. 2, cylindrical passageway 36 has low port pressure passageways, front and rear, 30 and 32, respectively, disposed in its top. High pressure passageways 34 are positioned at the end of barrel 22, to the rear of chamber 35. Strike plate 37 is held in position in passageway 36 by means of retaining ring 42, and setscrews 40 and 44 secure both of the latter. While the Figure illustrates integral installation in a revolver, the principle of integral installation of the muzzle brake device with the barrel is equally applicable to a semiautomatic handgun through the use of appropriate machining operations performed on the barrel.

While various ones of some of the features of the muzzle brake device described in the above have previously been known, with a muzzle brake device having components of the type described, in the relative positions called for, it has been found that there is a unique interactive relationship which not only produces significantly less recoil than would otherwise be experienced, but which considerably reduces cartridge casing ejection malfunction, as described.

While in accordance with the patent statutes, a preferred embodiment and best mode has been presented, the scope of the invention is not limited thereto, but rather is measured by the scope of the attached claims.

What is claimed is:

1. A muzzle brake device for a gun comprising in combination:

a housing;

means for securing said housing at the end of the gun's barrel; and a strike plate, wherein said housing includes therein a truncated conical expansion chamber having an annular surface in the shape of a horizontal, hollow, truncated cone, the base or muzzle end of which defines the transverse cross-sectional area of a cylindrical passageway also contained in said housing, and the truncated top or breech end of which defines the transverse cross-sectional area of the barrel bore of said gun, said strike plate being disposed in the cylindrical passageway at the muzzle end of said expansion chamber and having an angled planar surface facing said expansion chamber in the shape of the truncated planar surface of a hollow, annular, truncated cylinder, said truncated planar surface forming an angle relative to the bottom of said hollow, annular, truncated cylinder of from about 30° to about 45° and said truncated planar surface lying at right angles to the longitudinal vertical plane of the cylindrical passageway, and wherein said housing has a plurality of pressure port passageways connecting the interior of said housing to the outside of said housing.

2. A muzzle brake device for a gun according to claim 1 in which the maximum internal diameter of said expansion chamber is from about 1.5 to 2.0 times greater than the internal diameter of the barrel bore of said gun, and from about 0.62 to 0.64 inches long, and the angle of the surface defined by said horizontal, hollow, truncated cone is from about 10° to 15° relative to the axis of the horizontal, hollow, truncated cone.

3. A muzzle brake device according to claim 1 in which the strike plate in the cylindrical passageway at the muzzle end of said expansion chamber comprises a removable, hollow, annular, truncated cylinder, the truncated planar surface of which forms an angle relative to the bottom of said hollow, annular, truncated cylinder of from about 30° to about 45°, said truncated planar surface facing said expansion chamber, and said truncated planar surface being disposed at right angles to the longitudinal vertical plane of the cylindrical passageway, and wherein said hollow, annular, truncated cylinder is held in place by a removable retaining ring positioned adjacent to the base or muzzle end of said hollow, annular, truncated cylinder.

4. A muzzle brake device according to claim 1 in which said pressure port passageways include two low pressure passageways of elongated cross sectional the openings of which are disposed at the top of said housing, and the longer dimensions of which are at right angles to the longitudinal axis of the gun barrel, a first such low pressure port passageway being above and directly over the truncated surface of said strike plate, and the second such low pressure port passageway being above and directly over the area immediately adjacent to the base of said horizontal, hollow, truncated cone which defines the cross sectional area of said cylindrical passageway.

5. A muzzle brake device according to claim 4 in which the total cross sectional area of the openings defined by said low pressure port passageways is from about 0.21 to 0.23 square inches, and the first said low pressure port passageway has a cross sectional area of from about 1.4 to 1.6 times greater than said second low pressure port passageway.

6. A muzzle brake device according to claim 1 in which said pressure port passageways comprise both low pressure port passageways and high pressure port passageways, said low pressure port passageways comprising two passageways of elongated cross section disposed at the top of said housing, the longer dimension of which being at right angles to the longitudinal axis of the gun barrel, a first such low pressure port passageway being above and directly over the truncated planar surface of said strike plate, and the second such low pressure port passageway lying above and directly over the area immediately adjacent to the base of said horizontal, hollow, truncated cone which defines the cross sectional area of said cylindrical passageway, and in which said high pressure port passageways comprise a plurality of high pressure port passageways disposed in the top of said housing and connecting the exterior of said housing to the interior of said barrel bore, said high pressure port passageways being located between the rear or breech end of said housing and said expansion chamber.

7. A muzzle brake device according to claim 6 in which said high pressure port passageways are arranged in two parallel longitudinal lines, relative to the longitudinal axis of the gun barrel, each of the gun barrel, each lines, relative to the gun of said lines being spaced away from the center of said housing, said high pressure port passageways lying in vertical planes perpendicular to the gun barrel and connected with the center area of the gun barrel bore chamber at an angle of about 20° to about 45° from the vertical axis of the gun barrel.

8. A muzzle brake device according to claim 7 in which the combined cross sectional area of said high pressure port passageways is equal to about 15% to 35% of the cross sectional area of the gun barrel bore chamber.

9. A muzzle brake device according to claim 4 in which a third low pressure port passageway is disposed equidistant between said first and said low pressure port passageways.

10. A muzzle brake device according to claim 9 in which the total area defined by said low pressure port passageways is from about 0.30 to 0.32 square inches, said first and third low pressure port passageways being about equal in area, and said first and third low pressure port passageways each having an area of from about 3.5 to 4.5 times greater than said second low pressure port passageway.

11. A handgun provided with a muzzle brake device comprising in combination:

a housing;

means for securing said housing to the end of the gun's barrel;

a strike plate, wherein said housing includes therein a truncated, conical expansion chamber having an annular surface in the shape of a horizontal, hollow, truncated cone, the base or muzzle end of which defines the transverse cross-sectional area of a cylindrical passageway also contained in said housing, and the truncated top or breech end of which defines the transverse cross-sectional area of the barrel bore of said gun, said strike plate being disposed in the cylindrical passageway at the muzzle end of said expansion chamber and having an angled planar surface facing said expansion chamber in the shape of the truncated planar surface of a hollow, annular, truncated cylinder, said truncated planar surfaces forming an angle relative to the bottom of said hollow, annular, truncated cylinder of from about 30° to 45° and said truncated planar surface lying at right angles to the longitudinal vertical plane of the cylindrical passageway, and wherein said housing has a plurality of pressure port passageways connecting the interior of said housing to the outside of said housing.

12. A handgun according to claim 11 having a caliber of .45, .38, or 9 millimeter.

* * * * *